United States Patent [19]

Varner

[11] 4,274,315

[45] Jun. 23, 1981

[54] ELECTRONIC CONTROL SYSTEM FOR STRIP PEELING APPARATUS

[75] Inventor: Donald E. Varner, Hanover, Mass.

[73] Assignee: The Gillette Company, Boston, Mass.

[21] Appl. No.: 60,323

[22] Filed: Jul. 25, 1979

[51] Int. Cl.[3] ..... B23B 1/00; B23B 7/00; B23B 3/04

[52] U.S. Cl. ..... 82/47; 82/1 C; 82/48; 82/59; 82/29 A; 82/101; 72/324

[58] Field of Search ..... 82/46, 47, 48, 1 C, 82/59, 101, 29 A; 72/324

[56] References Cited

U.S. PATENT DOCUMENTS 3,355,971 12/1967 Vigor ..... 82/47
3,460,366 8/1969 Musial et al. ..... 72/324

FOREIGN PATENT DOCUMENTS 1522507 8/1978 United Kingdom .
1522508 8/1978 United Kingdom .
1522509 8/1978 United Kingdom .
2001569 2/1979 United Kingdom .
2001570 2/1979 United Kingdom .

OTHER PUBLICATIONS

"Advanced Continuous Gaging Techniques for Cold Strip Rolling Mills", Light Metal Age Magazine, Aug. 1975, pp. 16–19.

"Automatic Control of Tension, Speed and Position in Handling Metal Strip", Blast Furnace and Steel Plant Magazine, Mar. 1949, By J. H. Hopper–3 pp.

*Primary Examiner*—Harrison L. Hinson
*Attorney, Agent, or Firm*—Richard A. Wise; Scott R. Foster

[57] ABSTRACT

An electronic control system is arranged to supply appropriate electrical signals for controlling the rate of advancement of a cutting tool into a surface of a rotating billet for peeling and pulling a strip therefrom with a regulated thickness and tension.

15 Claims, 4 Drawing Figures

ELECTRONIC CONTROL SYSTEM FOR STRIP PEELING APPARATUS

BACKGROUND OF THE INVENTION

1. Field of the Invention

This invention relates to an electronic system for controlling apparatus for peeling and coiling continuous strips of metal cut from a rotating work piece and more particularly, to an electronic system for providing continuous control of both strip thickness and coiling tension.

2. Description of the Prior Art

Machines have been built to manufacture thin metal strip by continuously feeding or moving a cutting tool at a predetermined rate into the peripheral surface of a rotating metal billet so as to cut and peel a continuous metal strip therefrom.

The prior art machines include a tension producing coiling assembly as part of the peeling process. As an example, the coiling assembly includes a motor driven rotatable spindle with a wrapping mechanism to start the wrap. The rotating spindle pulls and coils the metal strip as it is peeled from the billet. An example of such a machine is described in U.S. Pat. No. 3,460,366 and U.K. Pat. No. 1,522,507.

Prior art metal peeling machines have included electronic circuitry arranged to control the surface speed of the billet and the speed of the peeled strip since the surface speed of the billet and the speed of the strip are also factors determining strip thickness. However, prior art control circuits are not arranged to continuously monitor and regulate strip tension. This is a decided disadvantage if the strip tension varies during the peeling operation because of an abrupt change in the metallurgy of the billet, because of a change in coolant, or because of a build up on the tool rake surface.

Referring to FIG. 1, there is shown a simplified block diagram of a prior art electronic control system 10 for a peeling machine having a variable speed DC drive motor 11 arranged to simultaneously rotate a main spindle 12 and a lead screw 13. The main spindle 12 is adapted to provide a stable support for a billet 14 of material, such as metal. The lead screw 13 positions and drives a cutting tool 15 suitable for cutting the material of the billet 14. When the billet 14 is securely mounted on the spindle 12, the motor 11 is operated so as to rotate the spindle and the lead screw 13 in a preferred direction to feed or advance a cutting edge 16 on the cutting tool 15 into the surface of the rotating billet 14.

The rate of advancement of the cutting tool 15 or feed rate is controlled by a mechanical gear box 17 serially connected between the main spindle 12 and the lead screw 13. The mechanical gear box 17 is adapted to permit an operator to select one of several discrete feed rates suitable for a particular operation. A strip 18 is cut or peeled from the billet 14 when the billet surface is rotated against the cutting edge 16 of the cutting tool 15. The cut strip 18 is threaded beneath a first guard roller 19, through a pair of pinch rollers 20, and finally wrapped on a spindle 21 rotatably driven by another variable speed DC motor 22. Tension is applied to the strip 18 as it is being wrapped around the wind up spindle 21. The spindle 21 pulls the strip 18 as it rotates about its longitudinal axis and wraps the strip 18 around itself. The pulling force or tension applied to the strip 18 is an important factor determinative of the strip thickness.

It has been determined that the resultant strip thickness is not always equal to the depth of the cut or infeed of the cutting tool 15. During the cutting operation, the material ahead of the cutting tool 15 is plastically compressed causing a cut strip to "gather" up to two and one half times the thickness of the depth of cut. The ratio of the resultant strip thickness to the depth of cut is termed "gather ratio". The gather ratio is dependent upon the material being cut, the tool rake angle, the cutting speed, and the tension applied to the material being cut from the billet 14. Increasing the tension applied to the strip 18 lowers the gather ratio and the resultant thickness of the strip 18 by placing the strip material under tensile stress, thereby decreasing the plastic compression tendencies ahead of the cutting edge. Therefore, the greater the tension that is applied to the strip 18, the thinner the strip 18 becomes and the faster it travels. Conversely, lowering the tension decreases the tensile stress in the strip 18 and allows it to thicken and travel slower. Thus, the gather ratio is also the ratio of the surface speed of the billet, $B_{SS}$, to the speed of the strip, LS. Gather ratio=billet surface speed/strip speed=strip thickness/feed rate.

In the prior art, electronic circuits are arranged to maintain a uniform strip thickness by controlling the ratio of the billet surface speed to the strip speed since the strip thickness is substantially equal to the product of the cutting tool feed rate multiplied by the gather ratio. In particular, the billet surface speed control circuit 23 includes a DC motor drive amplifier 24 having an output terminal 25 connected to a first terminal 26 of the main spindle motor 11. A second terminal 27 of the main spindle motor 11 is connected to ground potential 28. The amplifier 24 is adapted to amplify one or more input signals to provide an output signal, $e_3$, suitable for operating the main spindle motor 11 at a desired speed. For convenience, the amplifier 24 is shown as a high gain operational amplifier with a feedback impedance 29 and first 30 and second 31 input impedances each having a terminal electrically connected to a common summing junction 32 and an inverting terminal 33 of the amplifier 24. A non-inverting terminal 34 of the amplifier 24 is coupled to ground potential 28 via a suitable conductive path 35. The input impedances 30,31, feedback impedance 29, and the conductive path to ground 34 are resistors, capacitors, or a combination of resistors and capacitors arranged as known in the art to provide a desired functional relationship between amplifier input impedance and amplifier output impedance.

Another terminal of the first input impedance 30 is connected to a movable contact 36 of a three terminal potentiometer 37 having a first fixed terminal 38 connected to ground potential 28 and a second fixed terminal 39 connected to a fixed amplitude, negative DC voltage, $-V$, from a source, not shown. The potentiometer 37 functions as an adjustable voltage divider for providing a negative DC input voltage, $e_1$, to the amplifier, for setting billet surface speed. Another terminal 40 of the second input impedance 31 is connected to a movable contact 41 of a servo potentiometer 42 having a first fixed terminal 43 connected to ground potential 28. A second fixed terminal 44 of the servo potentiometer 42 is connected to a positive terminal 45 of a tachometer generator 46, which, in turn, is mechanically coupled to the main spindle 12 so as to generate a DC voltage having a magnitude proportional to the angular velocity of the main spindle 12. The movable contact 41 of the servo potentiometer 42 is driven and displaced by a suitable positional servo mechanism 47 coupled to the cutting tool 15. The servo potentiometer 42 functions as an adjustable voltage divider for providing a positive DC input signal, $e_2$, to the amplifier 24 that varies in proportion to the position of the cutting tool 15 and the angular velocity or speed of the main spindle 12. The amplifier output signal, $e_3$, applied to the main spindle motor 11 has a magnitude proportional to the difference in amplitude between the signal $e_1$ and the signal $e_2$. Consequently, the magnitude of the amplifier output signal, $e_3$, varies in proportion to the position of the cutting tool 15 and the speed of the main spindle 12. Thus, as the cutting tool 15 is moved into the rotating billet 14 at a fixed feed rate selected by the gear box 17, the main spindle 12 and billet 14 are rotated by the motor 11 at a speed that increases in inverse proportion to the decreasing radius of the billet 14, whereby the surface speed of the billet, $B_{ss}$, remains constant.

A control circuit 48 for the wind up spindle motor 22 includes a DC motor drive amplifier 49 such as a high gain operational amplifier having an output terminal 50 coupled to a first terminal 51 of the wind up spindle motor 22. A second terminal 52 of the motor 22 is connected to ground potential 28. The amplifier 22 includes a feedback impedance 53 connected between an amplifier inverting terminal 54 and the output terminal 50, an input impedance 55 with a terminal 56 connected to the inverting terminal 54, and a non-inverting terminal 57 of the amplifier 49 coupled to ground potential 28 via a suitable conductive path 58. The input impedance 55, feedback impedance 53, and the conductive path 58 are arranged as known in the art, to enable the amplifier 49 to operate in response to a DC voltage signal, $e_4$, from a line speed regulating circuit 59. The voltage signal, $e_4$, is applied to another terminal 60 of the input impedance 55 to enable the amplifier 49 to provide an output signal suitable for operating the motor 22 to rotate the spindle 21 and move the strip 18 through the rollers at a desired line speed.

The control circuit 59 for regulating the line speed of the strip 18 and establishing a fixed gather ratio or ratio of the billet surface speed to the strip speed includes a DC operational amplifier 61. An output terminal 62 of the amplifier 61 is coupled to the input impedance 55 of the amplifier 49 in the control circuit 48 for the wind up spindle motor 22. First 63 and second 64 gang tuned potentiometers each have a fixed terminal electrically connected to a common summing terminal 65 and an inverting terminal 66 of the amplifier 61. A movable contact 67 of the first potentiometer 63 is also electrically connected to the common summing terminal 65. A feedback impedance 68 is connected between the summing terminal 65 and the amplifier output terminal 62. A non-inverting terminal 69 of the amplifier 61 is coupled to ground potential 28 via a suitable conductive 70. A negative terminal 71 of a tachometer generator 72 is connected to a movable contact 73 and another fixed terminal 74 of the second potentiometer 64. A positive terminal 75 of the tachometer generator 72 is connected to ground potential 28. The tachometer generator 72 is mechanically coupled to one of the pinch rollers 20 so as to generate a DC voltage, $e_5$, having a magnitude proportional to the speed of the moving strip 18. The movable contact 41 of the servo potentiometer 42 is connected to another fixed terminal 76 of the first potentiometer 63 for conducting the voltage signal, $e_2$, proportional to the surface speed of the billet 14. Thus, the magnitude of the amplifier output signal, $e_4$, coupled to the wind up spindle motor drive amplifier 49 is proportional to the difference in amplitude between the line speed voltage signal, $e_5$, and the billet speed voltage signal, $e_2$. The position of the movable contacts 67,73 of the first 63 and second 64 gang tuned potentiometers is varied to provide a desired gather ratio and an amplifier output voltage, $e_4$.

SUMMARY OF THE INVENTION

In an electronic control system for a strip peeling machine including a drive circuit providing electrical signals for operating a motor to rotate a billet of material supported on a spindle at a first speed and advancing a cutting tool into the rotating billet for peeling a continuous strip of the material with a predetermined thickness therefrom for attachment to a wind up spindle, a strip speed regulating circuit for supplying an electrical signal to cause a second drive circuit to operate a second motor to rotate the wind up spindle to pull and move the strip at a second speed, the signal supplied by the regulating circuit being proportional to the difference between the speed of the moving strip and the speed of the rotating billet, the improvement comprises tension regulating means having a tension sensing circuit for sensing tension on the strip and supplying an input signal to an input terminal of a first amplifier circuit for causing the first amplifier circuit to provide an output signal to the second drive circuit for operating the second motor to rotate a wind up spindle and automatically maintain the predetermined tension on the strip. Switching means selectively disconnects the strip speed regulating circuit from the second drive circuit and connects the tension regulating circuit means to the second drive circuit. Feed motor means has a second amplifier circuit for supplying electrical signals to a feed motor coupled to the cutting tool in response to a first input electrical signal proportional to the first speed for operating the feed motor to advance the cutting tool at a first rate into the rotating billet for peeling the strip. Means for sensing strip thickness and selectively supplying a proportional electrical signal is coupled to an input terminal of the second amplifier circuit of the feed motor means to cause the second amplifier circuit to supply an electrical signal for operating the feed motor to advance the cutting tool at a second rate into the rotating billet to automatically maintain the predetermined thickness of the peeled strip.

DESCRIPTION OF THE PREFERRED EMBODIMENT

Figure 1:
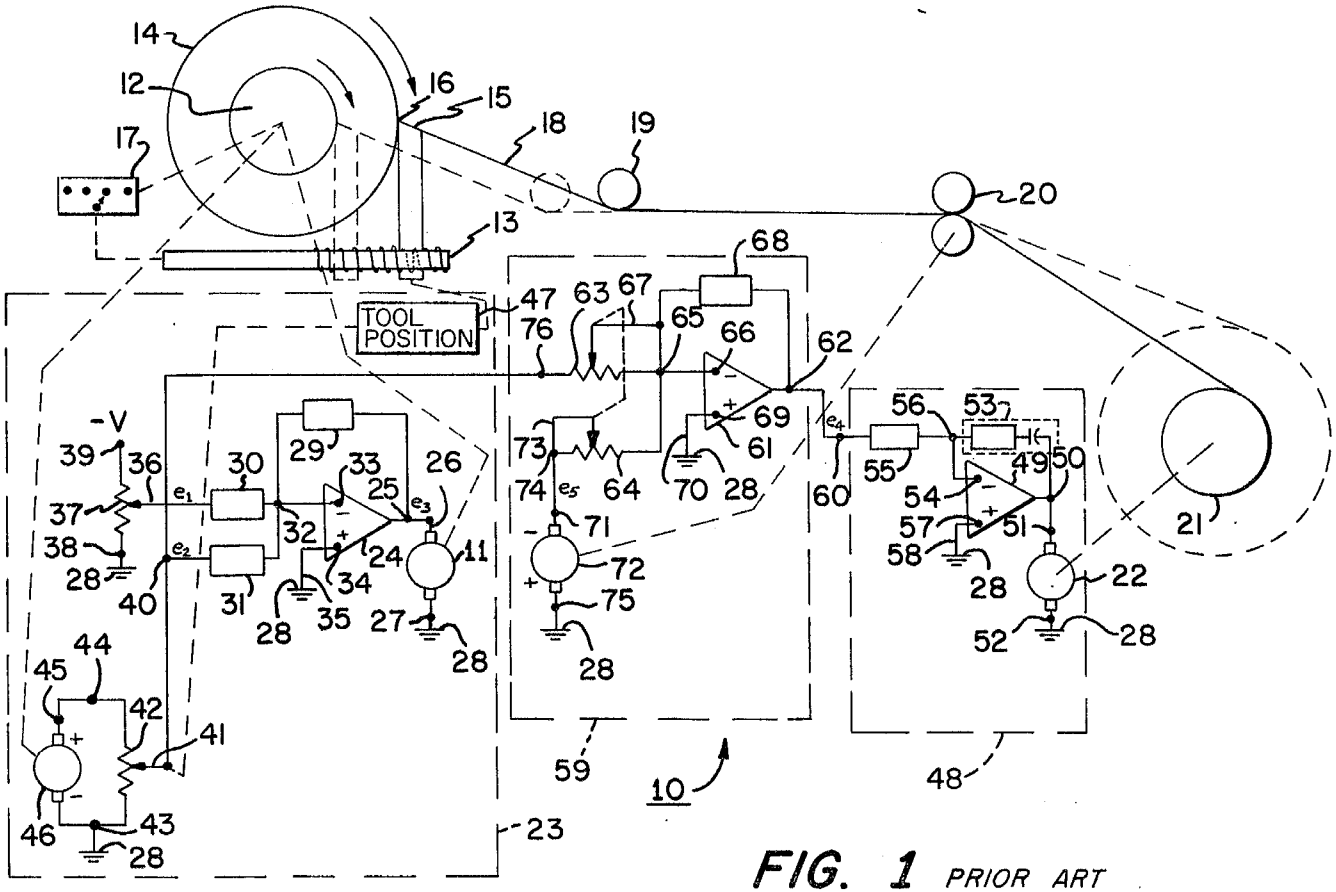
FIG. 1 PRIOR ART
FIG. 1 is a schematic drawing of a prior art electronic control system for a strip peeling machine.
Figure 2:
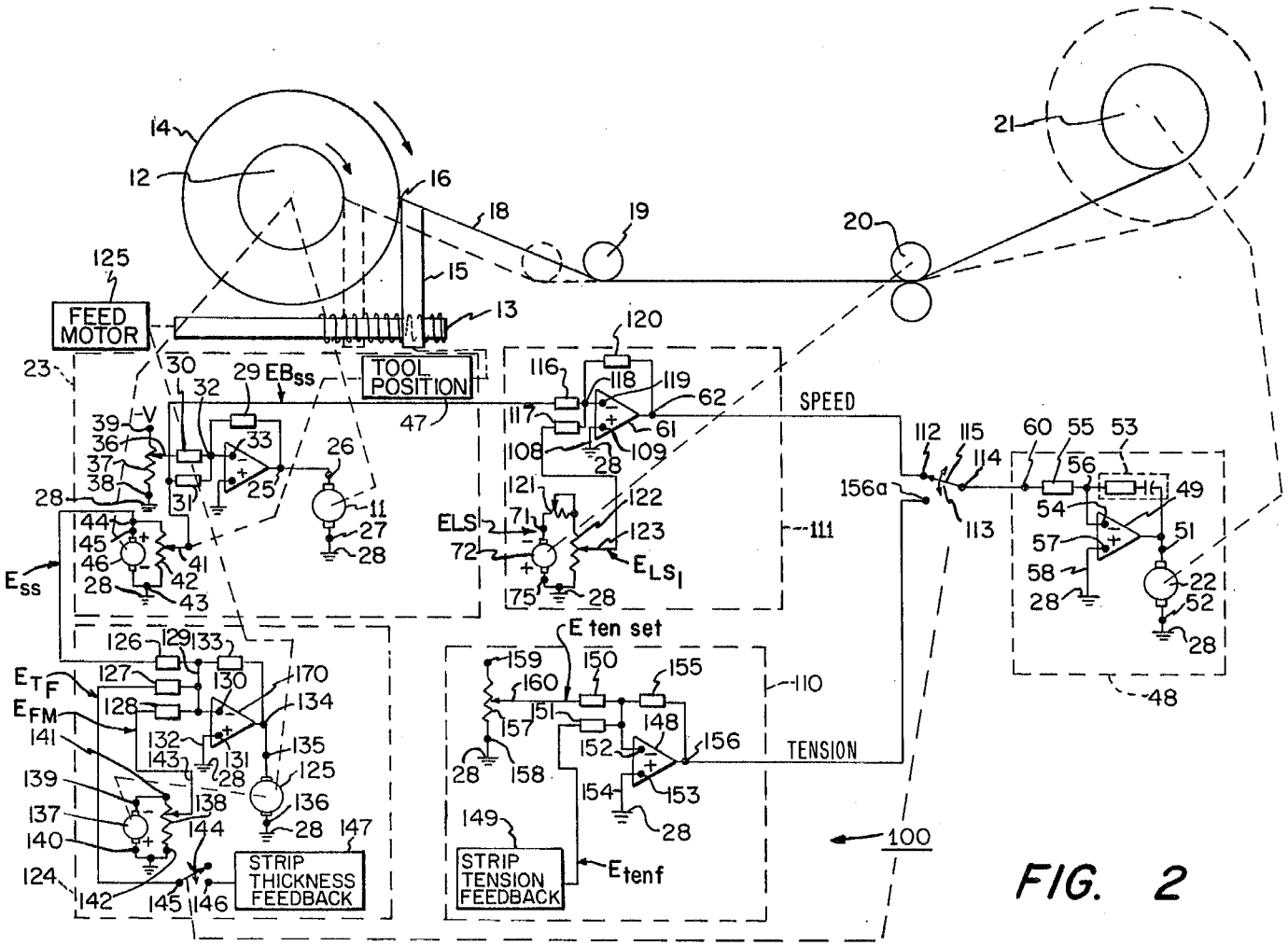
FIG. 2 is a schematic drawing of an electronic control system arranged according to the invention.

Referring to FIG. 2, there is shown a simplified block diagram of an electronic control system 100 illustrating the concept of the present invention. Ground connections, power supplies, and multiple leads coupling components of the system 100 together and necessary for proper operation of the system 100 are not shown but will be readily understood by those skilled in the art. For convenience, reference numerals indicating elements in FIG. 1 are used to indicate like elements in FIG. 2.

The prior art control circuit 23 is used in the present invention to provide suitable electrical signals for causing the main spindle motor 11 to rotate the main spindle 12 and billet 14 at a constant surface speed in the manner described above. The prior art control circuit 48 is used in the present invention to provide suitable electrical signals for causing the wind up spindle motor 22 to rotate the spindle 21 and move the strip 18 through the rollers 20 at either threading speed or a different speed determined by a strip tension regulating circuit 110 described below.

A line speed control circuit 111 for regulating the line speed of the strip 18 and establishing an adjustable gather ratio includes a DC operational amplifier 61. An output terminal 62 of the amplifier 61 is coupled to a first stationary contact 112 of a double pole double throw speed-tension selector switch 113 having an end 114 of a movable switch contact 115 connected to the input impedance 55 of the amplifier 49 in the control circuit 48. First 116 and second 117 input impedances have terminals connected to a common summing terminal 118 and an inverting terminal 119 of the amplifier 61. A feedback impedance 120 is connected between the summing terminal 118 and the amplifier output terminal 62. A non-inverting terminal 109 of the amplifier 61 is coupled to ground potential 28 via a suitable conductive path 108. The first and second input impedances 116,117 the feedback impedance 120 and the conductive path 108 are selected to provide a desired functional relationship between amplifier input impedance and amplifier output impedance.

Another terminal of the first input impedance 116 is connected to the movable contact 41 of the servo potentiometer 42 to provide a conductive path for conducting a DC voltage signal, $E_{Bss}$, proportional to the billet surface speed to the inverting terminal 119 of the amplifier 61.

A tachometer generator 72 having a positive terminal 75 and a negative terminal 71 is mechanically connected to one of the pinch rollers 20 so as to generate a DC voltage having a magnitude proportional to the line speed of the strip. The voltage generated by the tachometer 72 is applied across a resistive voltage divided circuit comprising a first potentiometer 121 serially connected to a gather ratio setting potentiometer 122. In particular the tachometer negative terminal 71 is coupled to a fixed terminal of the first potentiometer 121 and a tachometer positive terminal 75 is connected to a fixed terminal of the gather ratio potentiometer 122 and ground potential 28. At calibration, the resistance of the first potentiometer 121 is varied while the position of the movable contact 123 of the gather ratio potentiometer is varied to provide a desired DC voltage signal, $E_{LS1}$, proportional to the line speed of the strip being pulled through the rollers. Another terminal of the second impedance 117 is connected to the movable contact 123 of the gather ratio setting potentiometer 122 to provide a conductive path for conducting the DC voltage signal, $E_{LS1}$, to the inverting terminal 119 of the amplifier 61.

Unlike the prior art, the line speed regulating circuit 111 enables a user to vary the amplitude of the voltage signal, $E_{LS1}$, independent of the voltage signal $E_{Bss}$. Thus, a dial, not shown, may be mechanically attached to the movable contact of the gather ratio setting potentiometer 122 and calibrated to provide a direct setting of a variable gather ratio, $B_{ss/LS}$, since the billet surface speed, $B_{ss}$, is fixed and the strip speed, LS, is proportional to the voltage signal $E_{LS1}$. For example, the dial may be set at two, indicating that the magnitude of the strip speed, LS, is one half the magnitude of the billet surface speed, $B_{ss}$.

The feed rate of the cutting tool 15 and the thickness of the strip 18 is controlled by a circuit 124 adapted to provide a DC voltage signal for operating a motor 125 to move the cutting tool over a continuous range of speeds. The feed motor and thickness regulator circuit 124 includes an operational amplifier 170, having first 126, second 127, and third 128 input impedances with terminals connected to a common summing point 129 and amplifier inverting terminal 130. A non-inverting amplifier terminal 131 is coupled to ground potential 28 via a suitable conductive path 132 and a feedback impedance 133 is connected between an amplifier output terminal 134 and the summing terminal 129. The amplifier output terminal 134 is connected to a first terminal 135 of the feed motor 125. A second terminal 136 of the feed motor 125 is connected to ground potential 28. The first, second, and third input impedances, 126, 127, 128, the feedback impedance 133, and the conductive path 132 are selected as discussed above, to provide a desired functional relationship between amplifier input impedance and amplifier output impedance.

Means for setting the feed rate are connected to another terminal of the third input impedance 128. For example, the feed rate setting means include a tachometer generator 137 mechanically coupled to the feed motor 125 for generating a DC voltage proportional to the speed of the motor 125, and a potentiometer 138. The tachometer terminals 139,140, are connected across the fixed terminals 141,142, of the potentiometer 138 with a positive tachometer terminal 140 connected to ground potential 28. The resistance of the feed rate setting potentiometer 138 is varied by moving the movable contact 143 to provide a desired DC voltage, $E_{FM}$, proportional to the rotational speed of the feed motor 125. The movable contact 143 of the potentiometer 138 is connected to another terminal of the third input impedance 128 for conducting the voltage signal, $E_{FM}$, to the amplifier inverting terminal 130. A dial, not shown, may be attached to the movable contact 143 to provide a visual indication of relative position of the movable contact 143 of the potentiometer 138 and the feed rate of the cutting tool 15.

Another terminal of the first input impedance is connected to the positive terminal 45 of the main spindle tachometer 46 to provide a conductive path for a DC voltage signal, $E_{ss}$, proportional to the rotational speed of the main spindle 12.

A movable arm 144 of a single pole, single throw switch 145 arranged to move with arm 115 of the speed-tension control switch 113 is connected to another terminal of the second input impedance 127. A first fixed terminal 146 of the switch 113 is connected to a strip thickness sensing circuit 147 arranged to supply a voltage signal, $E_{TF}$, proportional to the thickness error to the amplifier 170 when the switch 145 is closed. A change in strip thickness can occur when the tension on the strip is changed. An example of a strip thickness sensing circuit 147 is described in "Advanced Continuous Gaging Techniques for Cold Strip Rolling Mills", by Friedich Vollmer, published in *Light Metal Age* magazine, August, 1975, issue, pages 16–19. The amplifier 170 responds to the input signals $E_{TF}$, $E_{FM}$, and $E_{ss}$ to provide a DC output signal suitable for causing the feed motor 125 to operate and move the cutting tool 15 into the billet 14 at a regulated feed rate to maintain a predetermined strip thickness. Thus, unlike the prior art, the rotational speed of the feed motor 125 and the corresponding feed rate of the cutting tool 15 varies automatically to adjust to changes in the rotational speed of the main spindle 12 and strip thickness, whereby the feed rate of the cutting tool 15 is regulated. When the switch 113 is in the speed position, the strip thickness sensing circuit 147 is disconnected from circuit 124 and the amplifier responds to the input signals $E_{ss}$ and $E_{FM}$ to supply a DC output signal to the feed motor 125 for moving the cutting tool 15 at a rate proportional to spindle speed. Actual thickness is a function of gather ratio setting. The cutting tool 15 is moved at a rate proportional to spindle speed when the peeled strip 18 is initially threaded around and through the rollers 19,20 and attached to the spindle 21.

The strip tension is continuously monitored and regulated by the strip tension regulating circuit 110 selectively connected to the control circuit 48 by the speed-tension selector switch 113. The strip tension regulating circuit 110 includes a high gain DC amplifier 148 and a circuit 149 for sensing strip tension. An example of the amplifier 148 is an operational amplifier having first 150 and second 151 input impedances with terminals connected to an amplifier inverting terminal 152. A non-inverting terminal 153 of the amplifier 148 is coupled to ground potential 28 via a suitable conductive path 154. A feedback impedance 155 is connected between the inverting terminal 152 and an amplifier output terminal 156. The first and second impedances 150,151, the feedback impedance 155, and the conductive path are selected, as known in the art, to provide a desired functional relationship between amplifier input impedance and amplifier output impedance. Means for setting the tension is connected to another terminal of the first input impedance 150. An example of a tension setting means is a voltage divider such as a potentiometer 157 having a bias voltage applied across a first fixed terminal 158 connected to ground potential 28 and a second fixed terminal 159. A movable contact 160 of the potentiometer 157 is connected to the first input impedance 150. The position of the movable contact 160 is varied to provide a DC voltage $E_{ten\ set}$ to the amplifier 148 for setting the tension on the strip 18. A calibrated dial may be attached to the movable contact 160 to provide a visual indication of the relative position of the potentiometer 157 and the strip tension.

The strip tension sensing circuit 149 is adapted to provide an output signal, $E_{ten\ f}$ proportional to strip tension, is connected to another terminal of the second input impedance 151 of the amplifier circuit 148. An example of a suitable strip tension sensing circuit 149 is described in "Automatic Control of Tension, Speed and Position in Handling Metal Strip", by J. H. Hopper, published in the magazine *Blast Furnace and Steel Plant*, March 1949. The amplifier 148 responds to the signals $E_{ten\ set}$ and $E_{ten\ f}$ to provide a variable amplitude DC output signal that is coupled to the amplifier 49 when the movable arm 115 of the speed-tension selector switch 113 is connected to the switch terminal 156*a*. The amplifier 49 then supplies a DC output signal with a magnitude that is automatically adjusted to changes in strip tension for operating the wind up spindle motor at a speed sufficient to maintain a predetermined tension on the strip 18. During the threading operation, the movable arm 115 provides a conductive path between terminals 112 and 114, the tension regulating circuit 110 is disconnected from the control system 100 and the strip 18 is threaded around and through the rollers 19,20 at a suitable threading speed determined by the output DC signal from the line speed regulating circuit 111.

Figure 3:
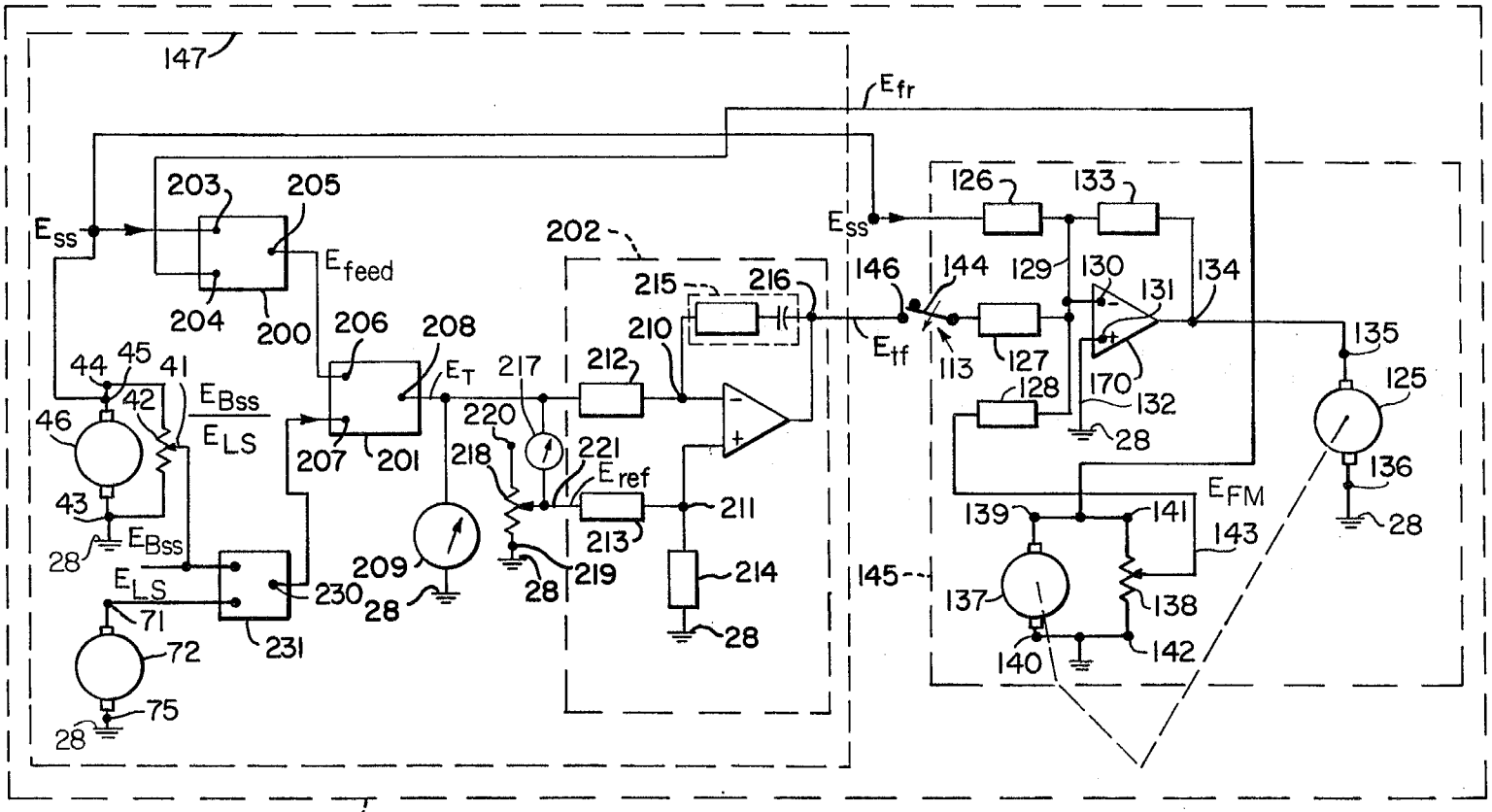
FIG. 3 is a block diagram of a strip thickness sensing circuit.

Referring to FIG. 3, there is shown a simplified block diagram of a preferred embodiment of the strip thickness sensing circuit 147 comprising an electronic divider circuit 200, an electronic multiplier circuit 201, an electronic divider circuit 231, and an amplifier circuit 202, included in another embodiment of the feed motor and thickness regulator circuit 124. The divider circuit 200 has a first input terminal 203 connected to the terminal of the spindle tachometer 46 so that a voltage signal, $E_{ss}$, proportional to the rotational speed (revolutions per min.) of the spindle 12 is transmitted to the divider circuit 200. A second input terminal 204 of the divider circuit 200 is connected to a terminal 139 of the feed rate tachometer 137 so that a voltage signal, $E_{fr}$, proportional to the feed rate (inch per minute) of the cutting tool, is transmitted to the divider circuit 200 from the tachometer 137. The divider circuit 200 is arranged, as known in the art, to act in response to the input signals, $E_{ss}$, and $E_{fr}$, to provide an output voltage signal, $E_{feed}$, (inches per revolution) proportional to the ratio of the voltage $E_{fr}/E_{ss}$, at the divider output terminal 205.

A first input terminal 206 of the multiplier circuit 201 is connected to the output terminal 205 of the divider circuit 200 so as to provide a conductive path for the voltage signal, $E_{feed}$, from the divider circuit 200. A second input terminal 207 of the multiplier circuit 201 is connected to the output terminal 230 of the divider circuit 231 so as to provide a conductive path for the output voltage signal proportional to the gather ratio voltage signal ($E_{Bss}/E_{LS}$). The multiplier circuit 201 is arranged, as known in the art, to act in response to the input signals, $E_{Bss}/E_{LS}$ and $E_{feed}$ to provide an output voltage signal $E_t$, at terminal 208, proportional to the arithmetic product of the gather ratio voltage signal and the feed voltage signal, $E_{feed}$. The voltage signal, $E_t$, is also proportional to the thickness of the peeled strip 18. A suitably calibrated meter 209 may be connected between the multiplier circuit output terminal 208 and ground potential 28 so as to act in response to the voltage signal, $E_t$, to provide a visual indication of the thickness of the peeled strip 18 in inches.

The voltage signal, $E_t$, and a reference voltage signal, $E_{ref}$ are coupled to inverting 210 and non-inverting 211 terminals, respectively, of the amplifier circuit 202 via input impedances 212 and 213. The input impedances 212,213,214, and a feedback circuit 215 are arranged, as discussed above, to provide a desired functional relationship between amplifier input impedance and amplifier output impedance. The magnitude of reference voltage signal, $E_{ref}$, is adjusted to set a target strip thickness and to cause the amplifier circuit 202 to respond to the difference in magnitude between the signals $E_t$ and $E_{ref}$ to provide a desired output voltage at terminal 216. The output voltage at the amplifier output terminal 216 is referred to as the thickness feedback voltage $E_{tf}$. A suitably calibrated meter 217 may be connected between the amplifier input impedances 212,213, to provide a visual indication of the difference between the reference voltage $E_{ref}$ and the thickness signal $E_t$.

Means for providing the adjustable reference voltage, $E_{ref}$ include a potentiometer 218 having a first fixed terminal 219 connected to ground potential 28 and a second fixed terminal 220 connected to a bias voltage source, not shown. A movable contact 221 of the potentiometer 218 is coupled to a non-inverting amplifier terminal 211 via the input impedance 213.

The movable arm 144 of the double pole, double throw speed-tension control switch 113 is connected to a terminal of the second input impedance 127 of the amplifier 170. A first fixed terminal 146 of the switch 113 is connected to the output terminal 216 of the amplifier 202 to provide a conductive path for the thickness feedback voltage $E_{tf}$, when the switch 113 is in a tension control position.

The terminal 45 of the main spindle tachometer 46 is connected to a terminal of the first input impedance 126 of the amplifier 170 so as to provide a conductive path for the voltage signal, $E_{ss}$. The amplifier 170 responds to the input signals, $E_{tf}$, $E_{FM}$, and $E_{ss}$ to supply a DC output signal to a first terminal 135 of the feed motor 125. A second terminal 136 of the feed motor 125 is connected to ground potential 28.

Means for setting the feed rate are connected to another terminal of the third input impedance 128. For example, the feed rate setting means include a tachometer generator 137 mechanically coupled to the feed motor 125 for generating a DC voltage proportional to the speed of the motor 125, and a potentiometer 138. The tachometer terminals 139,140 are connected across the fixed terminals 141,142 of the potentiometer 138 with a positive tachometer terminal 140 connected to ground potential 28. The position of the feed rate setting potentiometer 138 is varied by moving the movable contact 143 to provide a desired DC voltage, $E_{FM}$, proportional to the rotational speed of the feed motor 125. The movable contact 143 of the potentiometer 138 is connected to another terminal of the third input impedance 128 for conducting the voltage signal, $E_{FM}$, to the amplifier inverting terminal 130. A dial, not shown, may be attached to the movable contact 143 to provide a visual indication of relative position of the movable contact 143 of the potentiometer 138 and the feed rate of the cutting tool 15.

Figure 4:
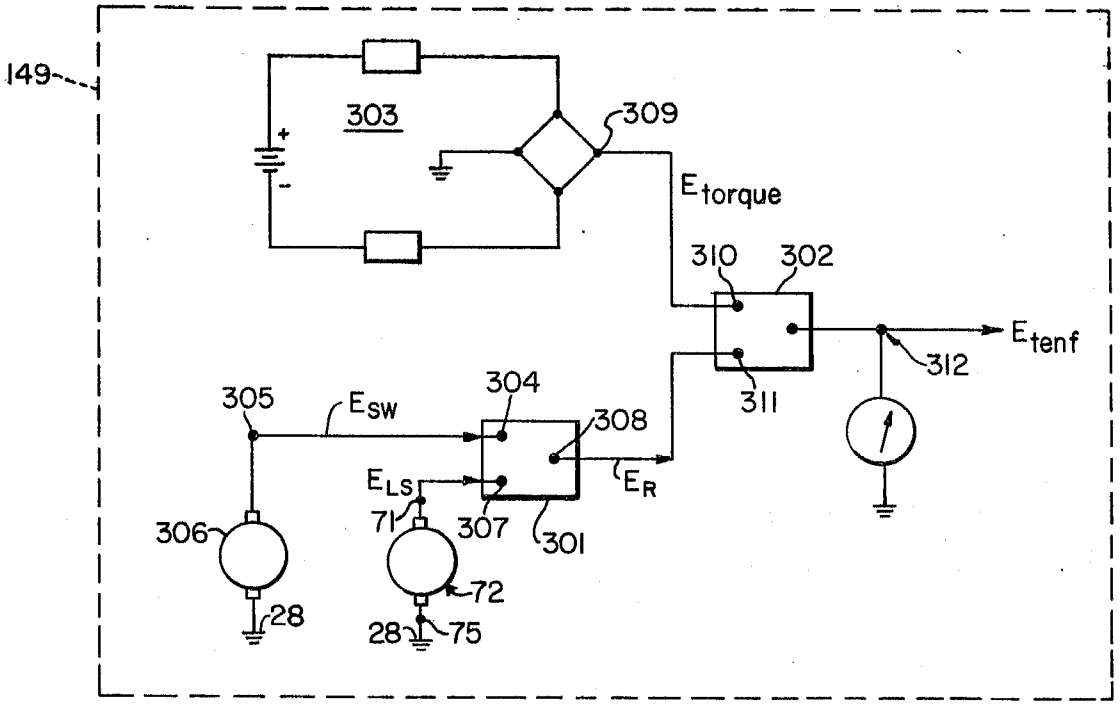
FIG. 4 is a block diagram of a strip tension sensing circuit.

Referring to FIG. 4, there is shown a simplified block diagram of a preferred embodiment of the strip tension sensing circuit 149 comprising first 301 and second 302 divider circuits and a torque transducer 303. The first divider circuit 301 has an input terminal 304 connected to the output terminal 305 of a tachometer 306 mechanically coupled to the windup spindle motor 22, whereby a voltage signal, $E_{SW}$, proportional to the angular velocity of the windup spindle 21, is coupled to the first divider 301. Another input terminal 307 of the first divider circuit 301 is connected to the output terminal 71 of the line speed tachometer 72 in FIG. 2 to provide a conductive path to the first divider circuit 301 for the voltage signal, $E_{LS}$, proportional to the speed (ft./min.) of the peeled strip moving through the pinch rollers 20. The first divider circuit 301 is arranged, as known in the art, to provide an output voltage, $E_R$, at terminal 308 proportional to $R_w = LS/2\pi S_w$, where $R_w$ is the radius (feet) of the billet of peeled strip being wrapped around the windup spindle 21, LS is the speed (ft./min.) of the peeled strip moving through the pinch rollers 20, and $2\pi S_w$ is the angular velocity (radians/min.) of the windup spindle 21.

The torque transducer 303 has an output terminal 309 connected to an input terminal 310 of the second divider circuit 302. The torque transducer 303 is arranged to supply the second divider circuit 302 with a voltage signal, $E_{torque}$, proportional to the rotation moment of the peeled strip being wrapped around the spindle 21. Another input terminal 311 of the second divider circuit 302 is connected to the output terminal 308 of the first divider circuit 301 to provide a conductive path for the voltage signal, $E_R$. The second divider circuit 302 has an output terminal 312 connected to the input impedance 151 of the amplifier 148 (FIG. 2) and is arranged as known in the art, to act in response to the input signals, $E_{torque}$, and $E_R$ to supply the amplifier circuit 148 with the voltage $E_{ten\,f}$ proportional to the voltage ratio $E_{torque}/E_R$ and the tension on the strip.

In summary, the electronic control system 100 includes a motor control circuit 23 for operating the main spindle motor 11 to rotate the billet at a constant surface speed and supplying a DC voltage signal, $E_{Bss}$, to the line speed regulating circuit 111 and a DC voltage signal, $E_{ss}$, to the feed motor circuit 124. When the speed-tension selector switch 113 is switched to the speed position, the line speed regulating circuit 111 furnishes a DC voltage suitable for driving the wind up spindle motor 22 at a desired threading speed, whereby the peeled strip 18 is threaded around and through the rollers 19,20 for attachment to the wind up spindle 21. When the speed-tension selector switch 113 is switched to the tension position, the strip tension regulating circuit 110 provides a DC output signal to the wind up spindle motor drive circuit 48 that is automatically adjusted to changes in strip tension, whereby the tension on the strip 18 is maintained at a predetermined level despite possible variances in the process. If the wind up spindle is caused to rotate at a different speed in order to maintain a uniform tension on the strip 18, the feed motor circuit 124 and thickness regulator 147 is adapted to automatically respond to operate the feed motor 125 to move the cutting tool 15 at a different speed so as to peel the strip 18 with a desired uniform thickness.

A method for peeling a continuous strip 18 of material from the billet 14 includes the following steps. The gather ratio is set to a desired magnitude by varying the position of the gather ratio potentiometer 122 in the line speed regulating circuit 111. The feed rate of the cutting tool 15 is set to a desired magnitude by varying the position of the movable contact 143 of the potentiometer 138 in the feed motor and thickness regulator circuit 124. Strip tension is set to a desired magnitude by varying the position of the movable contact 160 of the potentiometer 157 in the strip tension regulating circuit 110. The switch 113 is turned to the speed position and the main spindle motor and feed motor are operated at a threading speed to move the cutting tool 15 into the rotating billet 14 to cause a strip 18 to be peeled therefrom. A leading edge of the strip 18 is threaded beneath the roller 19, between the rollers 20, and then attached or wrapped around the wind up spindle 21. The wind up spindle motor 22 is then operated to rotate the wind up spindle 21 and tighten the wrap of the strip 18. The strip tension is metered by a suitable monitor and the position of the movable contact 123 of the gather ratio potentiometer 122 is varied, if necessary, to cause the wind up spindle motor 22 to rotate the wind up spindle 21 at a speed necessary for pulling the strip 18 with a desired tension. The strip thickness is metered by a suitable monitor and the position of the movable contact 143 of the feed rate potentiometer 138 is varied, if necessary, to cause the feed motor 125 to move the cutting tool 15 at a different rate into the rotating billet 14 to cut the strip 18 to a desired thickness. The switch 113 is then switched to the tension position to connect the strip tension regulating circuit 110 and strip thickness regulator 147 to the electronic control system 100, whereby strip tension and strip thickness are continuously monitored and corrective electrical signals are automatically supplied to the wind up spindle motor 22 and feed motor 125 if strip tension and thickness deviate from the desired value. Finally, the main spindle motor is operated at full speed.

One embodiment of the invention has been shown and described by way of example only. Various other embodiments and modifications thereof will be apparent to those skilled in the art, and will fall within the scope of the invention as defined in the following claims.

What is claimed as new and desired to be secured by Letters Patent of the United States is:

1. In an electronic control system for a strip peeling machine including a drive circuit providing electrical signals for operating a motor to rotate a billet of material supported on a spindle at a first speed and advancing a cutting tool into said rotating billet for peeling a continuous strip of said material with a predetermined thickness therefrom for attachment to a wind up spindle, a strip speed regulating circuit for supplying an electrical signal to cause a second drive circuit to operate a second motor to rotate said wind up spindle to pull and move said strip at a second speed, said signal supplied by said regulating circuit being proportional to the difference between said speed of said moving strip and said speed of said rotating billet, the improvement comprising:

tension regulating means having a tension sensing circuit for sensing tension on said strip and supplying an input signal to an input terminal of a first amplifier circuit for causing said first amplifier circuit to provide an output signal to said second drive circuit for operating said second motor to rotate said wind up spindle and automatically maintain a predetermined tension on said strip;

switching means for selectively disconnecting said strip speed regulating circuit from said second drive circuit and connecting said tension regulating circuit means to said second drive circuit;

feed motor means having a second amplifier circuit for supplying electrical signals to a feed motor coupled to said cutting tool in response to a first input electrical signal proportional to said first speed for operating said feed motor to advance said cutting tool at a first rate into said rotating billet for peeling said strip; and means for sensing strip thickness and selectively supplying a proportional electrical signal to an input terminal of said second amplifier circuit to cause said second amplifier circuit to supply an electrical signal for operating said feed motor to advance said cutting tool at a second rate into said rotating billet to automatically maintain said predetermined thickness of said peeled strip.

2. An electronic control system according to claim 1, wherein said tension regulating means include a voltage divider circuit connected to said input terminal of said first amplifier circuit to provide a DC voltage, $E_{tens}$, to said first amplifier circuit for setting said predetermined tension on said strip.

3. An electronic control system according to claim 2, wherein said voltage divider circuit is a potentiometer having a movable contact connected to said input terminal of said first amplifier circuit and a fixed contact connected to ground potential.

4. An electronic control system according to claim 1, wherein said feed motor means include a tachometer generator coupled to a second voltage divider circuit and said feed motor to supply a DC voltage, $E_{fm}$, proportional to rotational speed of said feed motor to said input terminal of said second amplifier circuit.

5. An electronic control system according to claim 4, wherein said second voltage divider circuit is a potentiometer having first and second fixed contacts connected in parallel with said tachometer generator and a movable contact connected to said input terminal of said second amplifier circuit.

6. In an electronic control system having a first motor means for rotating a billet of material and moving a cutting tool into said rotating billet to peel a continuous strip therefrom and a second motor means for rotating a wind up spindle and pulling said strip attached thereto, the improvement comprising:

tension regulating means having a circuit for sensing tension on said peeled strip and supplying a proportional electrical signal, said tension regulating means being connected to said second motor means to cause said second motor means to automatically maintain a predetermined tension on said strip;

third motor means coupled to said cutting tool for moving only said cutting tool into said rotating billet; and thickness regulating means having a circuit for sensing thickness of said peeled strip and supplying a proportional electrical signal, said thickness regulating means being connected to said third motor means to cause said third motor means to automatically move said cutting tool into said rotating billet at a variable rate to maintain a predetermined strip thickness.

7. An electronic control system according to claim 6, wherein said tension regulating means include an amplifier circuit having an output terminal coupled to said second motor and an input terminal coupled to said strip tension sensing circuit and means for setting said strip tension, whereby said amplifier supplies an electrical signal to said second motor to cause said second motor to automatically maintain said predetermined tension on said strip.

8. An electronic control system according to claim 7, wherein said means for setting said strip tension includes a voltage divider circuit being coupled to said amplifier input terminal.

9. An electronic control system according to claim 7, further including switching means serially connected between said second motor and said amplifier output terminal for selectively coupling said tension regulating means to said second motor.

10. An electronic control system according to claim 6, wherein said thickness regulating means include an amplifier circuit having an output terminal coupled to said third motor and an input terminal coupled to said strip thickness sensing circuit and means for supplying an electrical signal proportional to rotational speed of said first motor and means for supplying an electrical signal proportional to rotational speed of said third motor, whereby said amplifier supplies an electrical signal to said third motor to cause said third motor to automatically move said cutting tool into said rotating billet at a variable rate to maintain said predetermined strip thickness.

11. An electronic control system according to claim 10, further including switching means serially connected between said amplifier input terminal and said strip thickness sensing circuit.

12. An electronic control system according to claim 10, wherein said means for supplying said electrical signal proportional to said rotational speed of said third motor includes a tachometer generator.

13. A method of regulating tension and thickness of a strip of material continuously peeled from a surface layer of a rotating billet by relatively moving said billet and a cutting tool into cutting contact and pulling said resultant strip in tension over said cutting tool, which comprises:

continuously metering said strip tension and supplying a proportional electrical signal to operate a first motor to cause said resultant strip to be pulled at a variable speed to maintain a substantially constant strip tension; and continuously metering said strip thickness and supplying a proportional electrical signal to operate a second motor to cause said cutting tool to move into said cutting contact with said billet at a variable rate to peel said resultant strip with a substantially constant thickness.

14. A method as recited in claim 13, wherein the step of continuously metering said strip tension includes supplying a first voltage signal to an amplifier means for setting a desired tension on said strip and supplying a second voltage signal from a strip tension sensing circuit to said amplifier means for causing said amplifier means to supply said electrical signal proportional to said metered strip tension to operate said first motor.

15. A method as recited in claim 13, wherein the step of continuously metering said strip thickness includes supplying a first voltage signal proportional to rotational speed of said billet to an amplifier means and supplying a second voltage signal from a strip thickness sensing circuit to said amplifier means for causing said amplifier means to supply said electrical signal proportional to said metered strip thickness to operate said second motor.

* * * * *